US007270474B2

(12) United States Patent
Agnoff

(10) Patent No.: US 7,270,474 B2
(45) Date of Patent: Sep. 18, 2007

(54) TOURBILLON WATCH WINDER

(76) Inventor: Charles Agnoff, 1221 Great Oaks Dr., Wilmington, NC (US) 28405

( * ) Notice: Subject to any disclaimer, the term of this patent is extended or adjusted under 35 U.S.C. 154(b) by 165 days.

(21) Appl. No.: 11/263,719

(22) Filed: Nov. 1, 2005

(65) Prior Publication Data

US 2007/0097797 A1 May 3, 2007

(51) Int. Cl.
*G04B 3/00* (2006.01)
*G04D 3/00* (2006.01)

(52) U.S. Cl. ..... 368/206; 81/7.5

(58) Field of Classification Search ..... 368/206, 368/207–210, 216; 81/7.5
See application file for complete search history.

(56) References Cited

U.S. PATENT DOCUMENTS 2,917,955 A * 12/1959 Leger ..... 81/7.5
3,620,007 A 11/1971 Kauffman
4,057,958 A * 11/1977 Wuntch ..... 368/207
6,254,270 B1 * 7/2001 Agnoff ..... 368/206
6,439,761 B1 * 8/2002 Agnoff ..... 368/206
6,964,513 B1 * 11/2005 Agnoff ..... 368/206
2003/0076748 A1 4/2003 Rustioni

* cited by examiner

*Primary Examiner*—Vit Miska
*Assistant Examiner*—Sean Kayes
(74) *Attorney, Agent, or Firm*—MacCord Mason PLLC

(57) ABSTRACT

A watch winder includes a watch carrier having a longitudinal axis, a continuous outer wall having a plurality of detectable features, and a watch holder to support the watch relative to the longitudinal axis so that the watch rotates upon rotation of the carrier about the longitudinal axis; a drive means within a circuit including a controller to control the rotation of the watch carrier through successive winding cycles; and a sensor to detect the position of the detectable features, the controller stopping the carrier at the end of each cycle in response to detection of a given number of detectable features by the sensor, the feature detected at the end of each cycle being different from the feature detected by the sensor at the end of the immediately preceding cycle.

29 Claims, 5 Drawing Sheets

TOURBILLON WATCH WINDER

BACKGROUND OF THE INVENTION (1) Field of the Invention

The present invention relates generally to automatic watch winders for winding self-winding watches, and in particular to watch winders that end each winding cycle with the orientation of the watch carrier, and the watch supported thereon, at a predetermined number of degrees different from the orientation of the watch carrier at the end of the immediately preceding cycle, thereby imparting to the watch the accuracy and advantages of a tourbillon mechanism.

(2) Description of the Prior Art

The winding mechanism of a self-winding watch is comprised of a bearing mounted pendulum or rotor that is connected through a gear reduction system to the mainspring of the watch. Generally, the rotor can rotate 360° in either direction. However, there are also so-called "hammer" shaped rotors in older self-winding watches that have a limited travel of 150° to 220° rotation. In either case when the watch is worn, the user's random and often rapid arm movements cause the rotor to swing back and forth inertially in both directions around the rotor axis, thereby winding the watch spring. The watch spring generally stores sufficient energy to keep the watch operating 36-48 hours, whether worn or not. Thus, when worn daily, the watch will be sufficiently wound to maintain continuous operation. However, if the watch is not worn regularly, the user must wind the watch, either manually or with a watch winder, or the watch will stop.

Watch winders are typically comprised of an electric drive mechanism that rotates a watch carrier so that the rotor moves relative to the watch spring, thereby effecting winding of the watch. In many watch winders, the watch is supported on a holder with plane of the watch being perpendicular to the axis of rotation. That is, the rotor axis is parallel to the axis of rotation of the drive mechanism, so that the watch rotates in the same plane as the hands of the watch. During the period of activation, the watch is partially or completely rotated several times either in a clockwise or counter-clockwise direction or, alternately, reversing in both directions. The powered rotation of the watch may be controlled to limit the turns per day (TPD) to prevent damage or malfunction due to the forces exerted on the winding mechanism.

One disadvantage of existing watch winders is the inaccuracy imparted to the watch mechanism by the effects of gravity. The effect of gravity on the accuracy of a watch mechanism was first observed in 1795 by Abraham-Louis Breguet. The effect was particularly pronounced in pocket-watches that were carried in the same pocketed position for most of the day, i.e., with the watch being in the same orientation for extended periods of time. Breguet designed a mechanism, known at a "tourbillon" mechanism to counter this effect. In a tourbillon mechanism, the entire escapement assembly including the balance wheel, escapement and pallet fork is mounted for rotation within the watch assembly.

The advent of watches which are worn on the wrist has negated the need for a tourbillon mechanism as an accuracy improver. The random motions of the wrist during the day in effect provide all of the multi-positional needs for averaging out the effect of gravity on the watch's accuracy. Consequently, the modern tourbillon is more an example of fine craftsmanship and an expression of high quality than it is a rate adjustment tool.

However, with the advent of watchwinders, the original positional problem returns. The watchwinder is only active for a short time, e.g., one hour, each day. Consequently, for the remaining time the watch is in a fixed position with the axis of rotation horizontal or slightly tilted, in effect, the same as it would be if it were a pocket watch in the olden days. Thus, there is a need for a watchwinder that negates the effect of gravity, and provides the advantages of a tourbillon mechanism to any watch being wound on the watchwinder.

SUMMARY OF THE INVENTION

Unlike prior art watch winders in which the watch carrier and watch are positioned at the same or a random orientation at the end of each winding cycle, the present watch winder achieving this desired tourbillon effect by stopping the watch carrier at the end of each cycle with the orientation of the watch carrier being at a predetermined number of degrees different from the orientation of the watch carrier at the end of the immediately preceding cycle. By initiating numerous winding cycles during a 24 hour period, the watch will not remain at any given orientation for any significant period. As a result, there is no significant inaccuracy resulting from gravitational effects.

Generally, the watch winder of the present invention is comprised of a watch carrier having a longitudinal axis adapted to support a self-winding watch having a rotor and spring so that the rotor moves relative to the spring upon rotation of the watch carrier about its longitudinal axis, a drive means for rotating the watch carrier about its longitudinal axis during winding cycles, and a controller to control the rotation of the watch carrier through successive winding cycles, the controller stopping the watch carrier at the end of each cycle with the orientation of the watch carrier being at a predetermined number of degrees different from the orientation of the watch carrier at the end of the immediately preceding cycle.

A "winding cycle" in its broadest senses is an activation of the watch winder drive means causing the watch carrier to rotate a predetermined number of degrees followed by inactivation of the drive means. Winding cycles will be separated by rest or inactive periods of a predetermined length of time. The number of degrees of rotation of each winding cycle will be different from the number of degrees of rotation of the immediately preceding winding cycle. That is, the degrees of rotation of each winding cycle will be equal to the degrees of rotation of the immediately preceding winding cycle, plus or minus an increment of a predetermined number of degrees. The number of degrees of the winding cycle may be more or less than 360°.

To illustrate, the number of degrees of each winding cycle may be equal to the number of degrees of the immediately preceding winding cycle± from 10° to 30°.

The number of degrees of difference in the winding cycles is preferably at least 360° or a multiple thereof plus or minus the increment. Also, the increment is preferably equally divisible into 360 so that the positions of the watch carrier will repeat after completion of a number of winding cycles equal to 360 divided by the increment. For example, the number of degrees of the winding cycle may be 360° plus 30°, resulting in the watch resting at 12 different positions before the winding cycles are repeated.

The controller can be programmed in various ways to ensure that the watch carrier cycles end with the watch carrier in the desired location and that the desired predetermined rest time transpires between winding cycles. For example, the controller can be programmed to close the circuit to the drive motor for a predetermined time which, combined with the known gear ratios and motor speed, will result in the desired degree of rotation of the watch carrier shaft.

Alternatively, the watch winder can include a sensor in the control circuit, with the sensor being programmed to detect a plurality of detectable features on the watch carrier. The controller can then be programmed to open the circuit responsive to detection of the detectable features by the sensor, stopping the watch carrier with one of the detectable features at a predetermined location.

For example, a plurality of equidistant detectable features, e.g., reflective dots, may be positioned around the periphery of the watch carrier so that the features successively pass the stationary sensor when the watch carrier is rotated. The controller can then be programmed to count the number of sensed features, opening the circuit and stopping the watch carrier at a predetermined position after a predetermined number of features have been counted. By counting a number of features more or less than the number of features positioned around the carrier, the watch carrier will stop at a different location at the end of each winding cycle. For example, if the number of features is 12 and the controller is programmed to stop at the end of each winding cycle after 13 features have been sensed, the watch carrier at the end of each cycle will be oriented 30° from its position at the end of the immediately preceding cycle.

The present invention is applicable to a wide range of watch winders. For example, a watch winder of the type described in co-pending U.S. patent application Ser. No. 11/008,487, filed Dec. 9, 2004 by the present inventor, the application being incorporated herein in its entirety, may be modified for practice of the present invention by the inclusion of a plurality of detectable features instead of the single detectable feature described in that application, and by the modification of the controller to respond to multiple sensed features as described above.

More specifically, one kind of suitable watch winder may be comprised of a watch carrier and a rest to support and rotate the watch carrier for predetermined periods at selected times. The watch carrier is freely supported on the rest. The term "freely supported" as used herein means that the watch carrier is only secured to the rest by the weight of the watch carrier. As a result, the carrier can be quickly removed or replaced with another watch carrier, or reversed, i.e., turned end-to-end to reverse the direction of rotation of the carrier and any watch supported within the carrier.

The watch carrier is comprised of a horizontal cylinder or drum, i.e., a cylinder having a given diameter, a longitudinal axis, a continuous outer wall of a given length, and a watch holder insertable into the cylinder's interior through either end of the cylinder. The cylinder may be closed at one end. As will be described hereinafter, the cylinder preferably includes radial flanges extending outwardly from each end to position the cylinder on the rest.

Preferably, the watch holder has an outer watch-carrying face that is perpendicular to the longitudinal axis of the cylinder so that the watch can be mounted with the watch face and the plane of rotation of the rotor perpendicular to the longitudinal axis of the cylinder. It will be understood, however, that other orientations are contemplated, the only criteria being that the entire watch rotates and that the watch rotor moves relative to the watch spring upon rotation of the watch. For example, instead of being perpendicular to the longitudinal axis, the watch may be supported with the watch face in a plane that is tilted relative to perpendicular, e.g., up to about 45° degrees relative to perpendicular.

The holder in the preferred embodiment may be of various constructions so long as it is insertable into the cylinder. The holder is preferably compressible to facilitate attachment and removal of a watch. For example, all or a part of the holder may be made of foam or other compressible material, or all or a part of the holder may be constructed of rigid spring-loaded sections that can be compressed.

The cylinder rest is adapted to freely support the cylinder in a horizontal, or tilted, e.g., up to 45° above or below horizontal, position and includes at least one drive surface positioned to engage and rotate the cylinder when the cylinder is supported on the rest. While the drive surface is described in the preferred embodiment as a roller, it will be appreciated that other drive surfaces, e.g., a belt, may also be used. The drive surface is rotated by an electric motor while engaging the cylinder wall, causing the cylinder to rotate. The engagement may be a frictional engagement, or a geared engagement with the drive surface and cylinder wall including outwardly projecting, meshing gears. When a frictional engagement is used, either the drive surface or cylinder outer wall, or both, will be covered with a non-slippery material, e.g., rubber or polyurethane.

In a preferred embodiment, the rest is comprised of first and second support sections having parallel longitudinal axes spaced from each other at a distance less than the given diameter of the cylinder. Each support section includes opposed ends and rollers adjacent the ends. The rollers of each section are perpendicular to and axially aligned with the section longitudinal axis, with all of the rollers having upper edges in a common horizontal plane. Thus, the cylinder will freely rest horizontally on the upper periphery of the rollers. At least one of the rollers is a drive roller positioned to engage the outer wall of the cylinder to rotate the cylinder when the cylinder is supported on the rollers. The support section including the drive roller, or both sections, may also include a housing between the rollers. The housing may be, for example, a cylindrical housing having a diameter less than the diameters of the rollers.

The housing of the support section including the drive roller may enclose the electric motor used to rotate the drive roller. The motor may be directly connected to the drive wheel by mounting the drive roller on the shaft of the motor, or the motor may be connected through intermediate gearing. The motor in turn is connected in a circuit with a power source, e.g., a battery or other electric power supply, a switch to open and close the circuit, and a programmable controller to control the frequency, direction, and length of time that the motor is energized. The battery and controller may be mounted in an enclosure with the rest being mounted on top of the enclosure. In this case, the connection of the battery and controller to the motor may be through one of the mounts for the support section including the motor, thereby hiding the source of rotation of the cylinder. The switch may be mounted on the exterior of the enclosure. The battery may also be mounted remotely.

The watch winder also includes a sensor in the control circuit, with the sensor being programmed to detect a plurality of detectable features located on the cylinder in a common plane transverse to the longitudinal axis of the cylinder. The controller is programmed to open the circuit when a predetermined number of detectable features are detected by the sensor, with the predetermined number of features being more or less than the number of features on the cylinder.

In operation, the user mounts a watch on the watch holder, e.g., by compressing the holder and slips the watch band around the holder with the watch face being positioned on the outer face of the holder. The holder is then inserted into either end of the cylinder with the watch recessed slightly from the cylinder end. The cylinder is then placed on the rest so that the rollers contact the surface of the cylinder. The motor is then energized either by the controller or manually with the switch, initiating a first winding cycle.

As the cylinder rotates, the watch carried on the watch holder also rotates. The rotor, however, hangs downward and does not rotate. Therefore, the watch is wound due to the relative movement of the watch mechanism, in particular the watch spring, and the rotor. Rotation of the cylinder carries the detectable features sequentially past the sensor, which transmits a signal to the controller each time a feature is detected. When a predetermined number of signals have been received by the controller, the controller causes the circuit to open, stopping the cylinder with the last detected feature adjacent the sensor. The controller is programmed to open the circuit when a predetermined number of features different from the total number of features on the cylinder is sensed, thereby stopping the cylinder and the watch supported thereon at an orientation different from the orientation at the end of the immediately preceding cycle. Since the cylinder and watch are stopped at different predetermined locations after each cycle and since the watch winder is programmed to undergo several cycles, e.g., from about 500 to about 1300 cycles during a twenty-four hour period, the watch will not remain at any given orientation for a prolonged period. Therefore, the adverse effects of gravity are avoided and the advantages previously achievable only with a tourbillon mechanism are achieved.

It will be understood that the application of the invention to the above watch winder construction is merely illustrative and that the invention can be adopted to other watch winder designs. For example, the watch carrier may be supported on a drive shaft, with the watch carrier being rotated upon rotation of the drive shaft on its longitudinal axis. The carrier may be adapted to support the watch so that the longitudinal axis extends through the central shaft of the watch, i.e., the watch shaft supporting the watch hands, or the carrier may support watch offset from the longitudinal axis. For example, the carrier may support two watches with the watches being spaced on either side of the longitudinal axis.

DETAILED DESCRIPTION OF THE INVENTION

Figure 1:
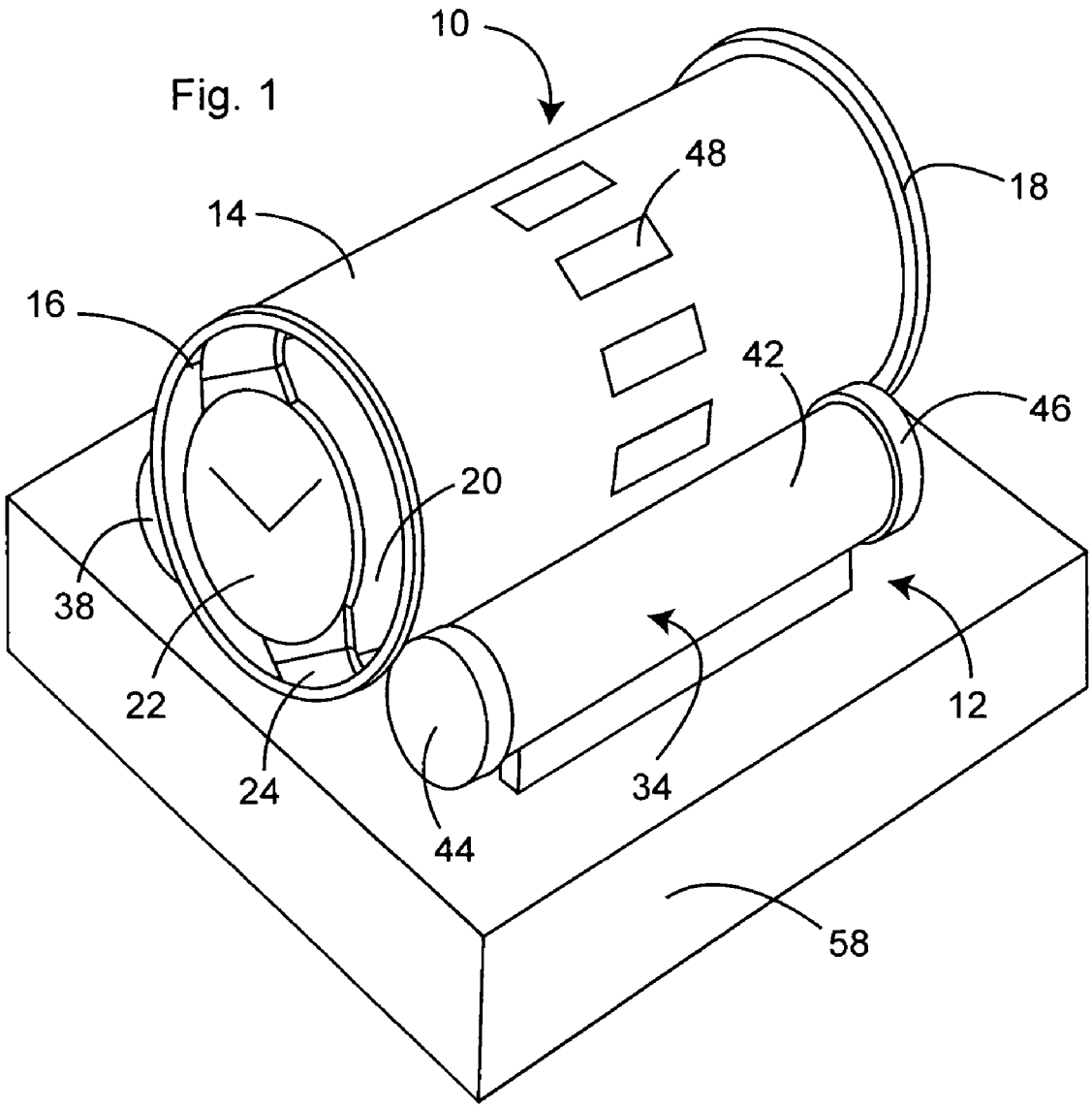
FIG. 1 is a perspective view of a preferred embodiment of the watch winder.
Figure 2:
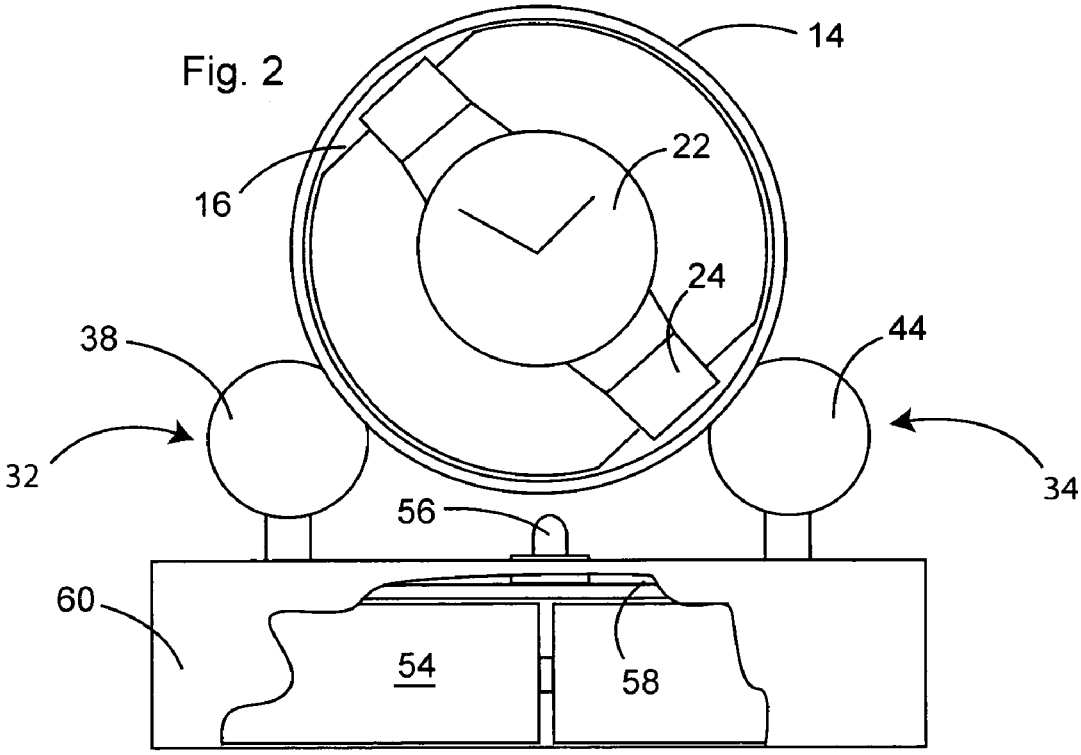
FIG. 2 is a front view of the watch winder of FIG. 1, with a cut-away section to show the interior of the lower enclosure.
Figure 3:
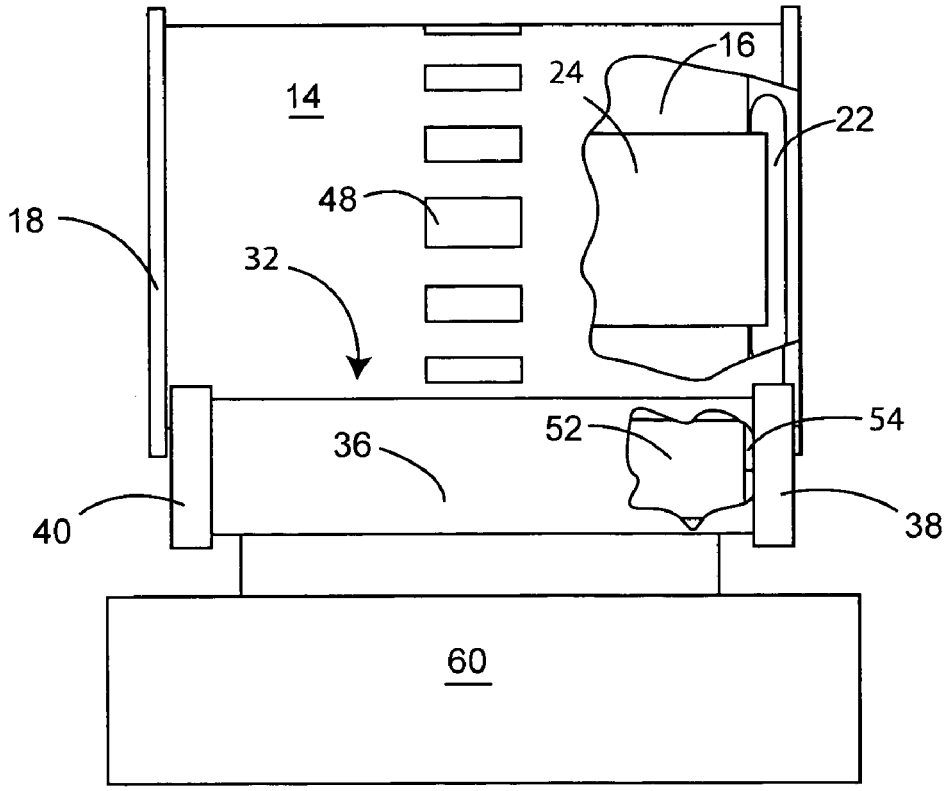
FIG. 3 is a side view of the watch winder of FIG. 1.

As best illustrated in FIGS. 1-3, a preferred embodiment of the watch winder of the present invention is comprised of a watch carrier, generally 10, and a rest, generally 12, to freely support watch carrier 10. Watch carrier 10 is comprised of horizontal cylinder 14 having a given diameter, a longitudinal axis, a continuous outer wall of a given length, an interior chamber defined by the inner wall of cylinder 14, and opposed ends, and watch holder 16 insertable into the interior chamber of cylinder 14. Cylinder 14 includes radial flanges 18 adjacent its ends.

Watch holder 16 includes watch-carrying face 20 perpendicular to the longitudinal axis of cylinder 14 so that watch 22 with watchband 24 can be mounted with the watch face and the plane of rotation of the rotor perpendicular to the longitudinal axis of cylinder 14. Holder 16 may be of various constructions so long as it is insertable into cylinder 14.

Rest 12 is comprised of first and second support sections 32 and 34, respectively, having parallel longitudinal axes spaced from each other at a distance less than the given diameter of cylinder 14. First support section 32 includes cylindrical housing 36 having opposed ends and rollers 38 and 40 adjacent the ends of housing 36. Similarly, second support section 34 includes cylindrical housing 42 having opposed ends and rollers 44 and 46 adjacent the ends of housing 42. Roller 38 is a drive roller positioned to engage the outer wall of cylinder 14 to rotate cylinder 14 when cylinder 14 is freely supported on the upper peripheral surfaces of rollers, 38, 40, 44 and 46.

Figure 8:
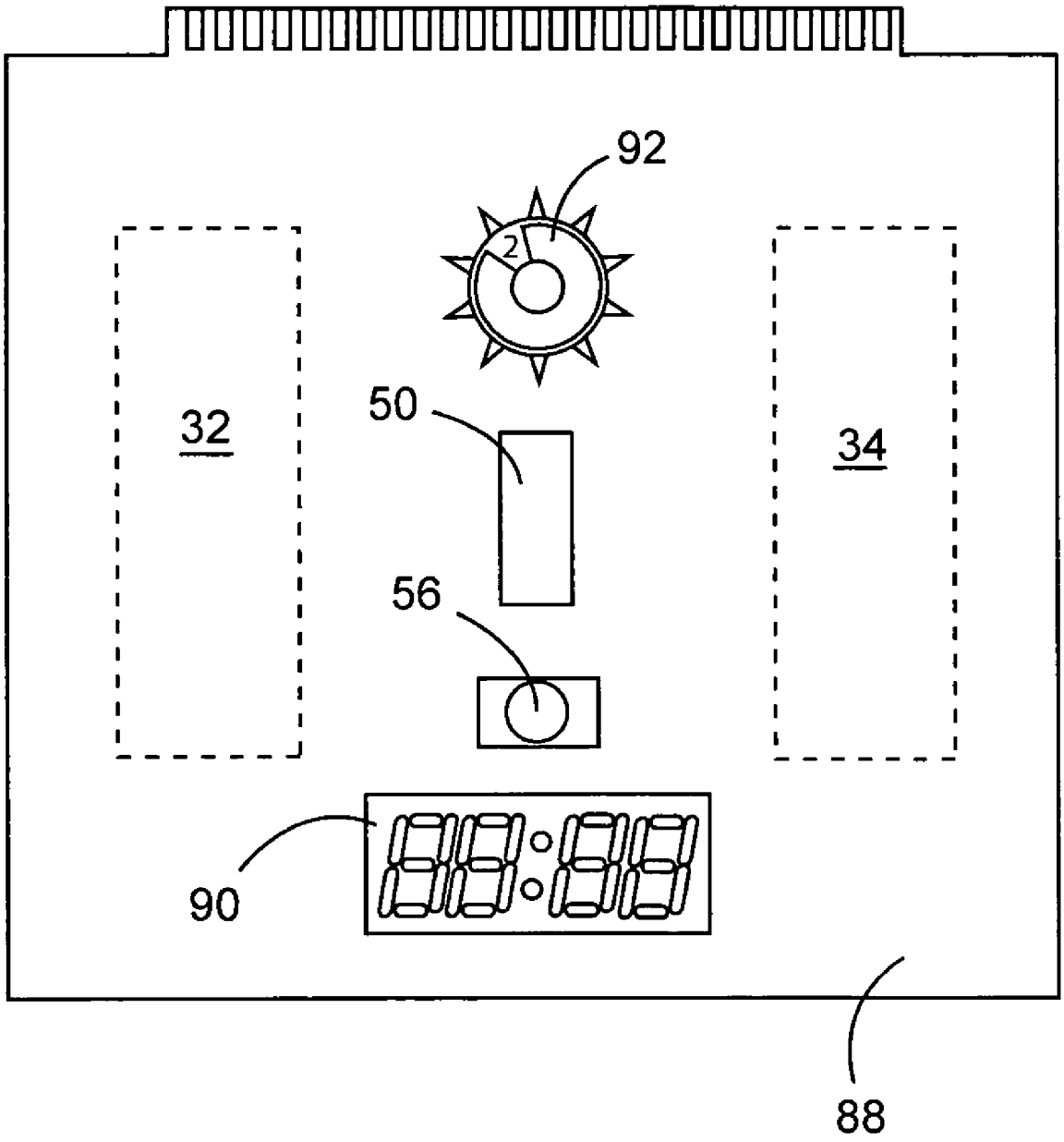
FIG. 8 is a circuit board mountable on the upper surface of the watch winder enclosure.

Cylinder 14 includes a plurality of detectable features 48, e.g., reflective tabs or dots, positioned equidistant around the periphery of cylinder 14 in a plane perpendicular to the longitudinal axis of housing 34. As shown in FIG. 8, a stationary sensor 50 is located within the plane of features 48, so that each of features 48 will pass adjacent sensor 50 as cylinder 14 rotates. Sensor 50, e.g., an optical sensor, acts as a counter to detect the presence of each of features 48 as features 48 pass adjacent sensor 50.

Housing 36 encloses electric motor 52 used to rotate drive roller 38 mounted on shaft 54 of motor 52. As shown in FIG. 2, motor 52 is also connected in a circuit with batteries 54, switch 56, and programmable controller 58, which receives inputs from sensor 50 whenever sensor 50 detects an adjacent feature 48, and opens the circuit whenever a programmed number of features 48 have been detected. Controller 58 is also programmable to control the length of time between winding cycles, and the direction of rotation motor 52. Batteries 54 and controller 58 are shown mounted in enclosure 60.

Figure 4:
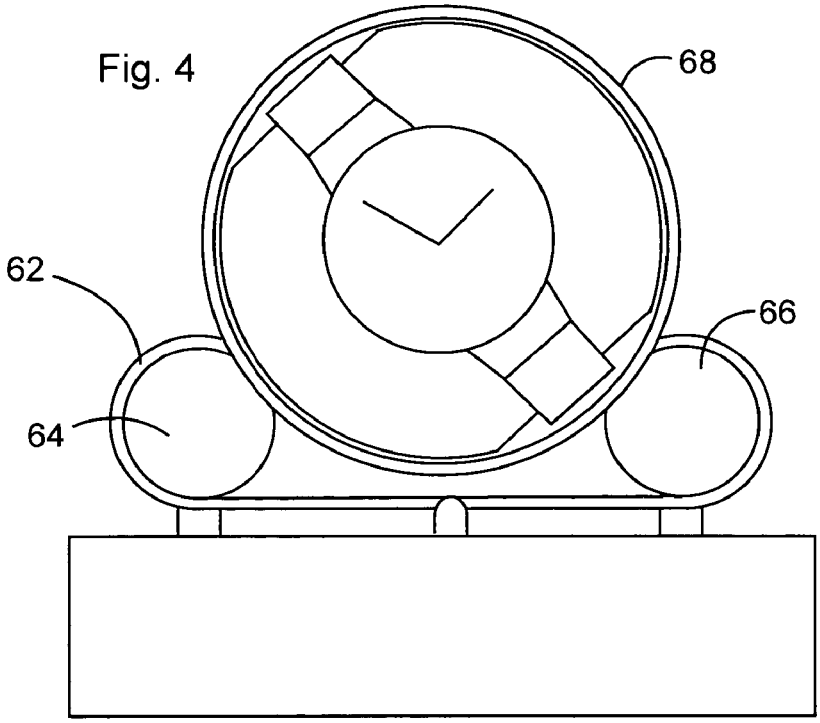
FIG. 4 is a front view of another embodiment of the invention using a belt drive.

FIG. 4 illustrates an alternative embodiment differing from the above embodiment in that a continuous belt 62 is positioned around rollers 64 and 66, with cylinder 68 resting on the upper surface of belt 62. Rotation of drive roller 64 rotates belt 62 and roller 66, and thereby cylinder 68.

Figure 5:
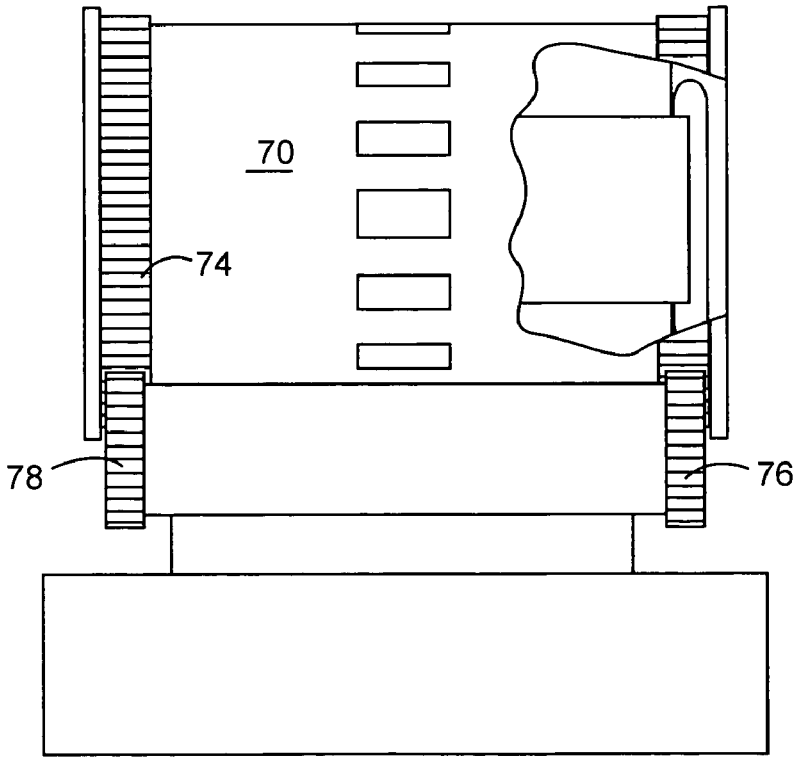
FIG. 5 is a side view of still another embodiment of the invention using a gear drive.

FIG. 5 illustrates still another embodiment differing from the above embodiments in that cylinder 70 includes radial gears 72 and 74, and rollers 76 and 78 include radial gear teeth meshing with the teeth of radial gears 72 and 74. Thus, rotation of drive roller 76 causes rotation of cylinder 70 through interaction of the gear teeth.

Figure 6:
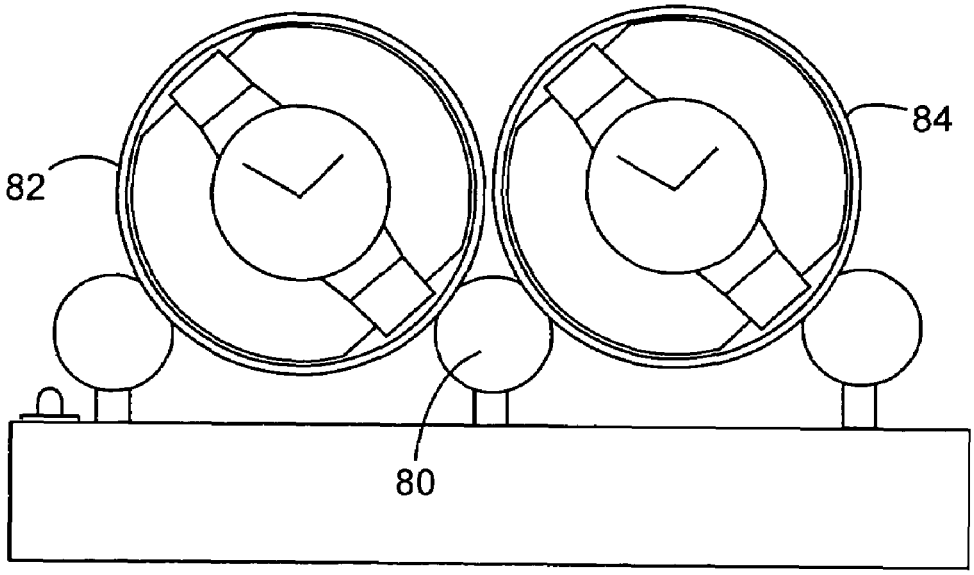
FIG. 6 is a front view of still another embodiment of the invention for use in simultaneously winding two watches.
Figure 7:
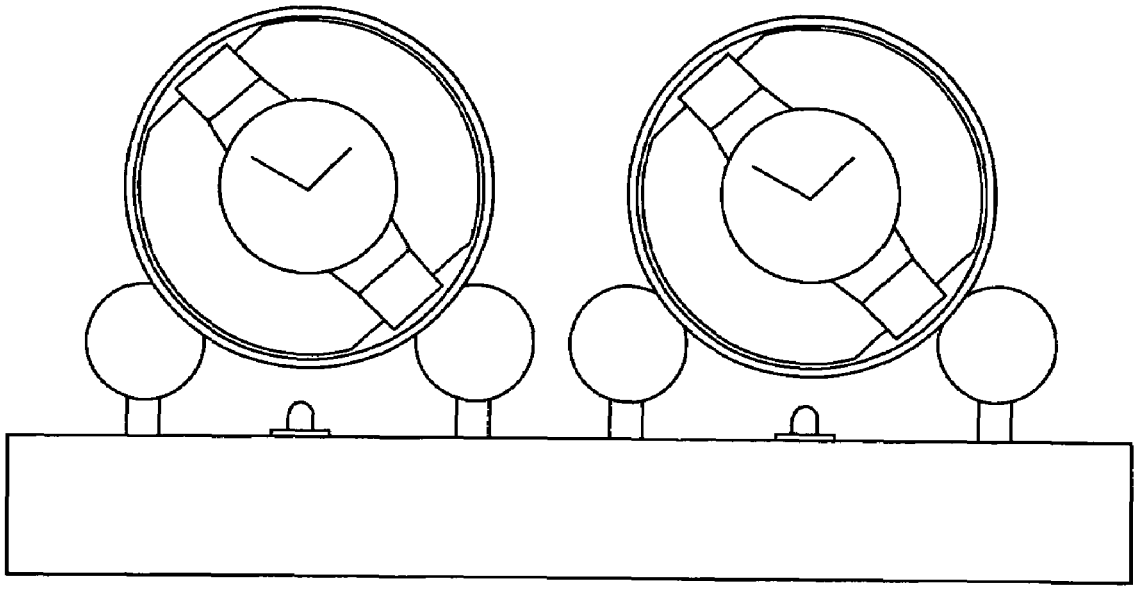
FIG. 7 is a front view of still another embodiment of the invention showing two watch winders mounted on a common base.

FIGS. 6 and 7 illustrate embodiments of the above watch winders designed to simultaneously rotate two cylinders, and thereby permit simultaneous winding of two watches. It will be understood that this concept can be expanded to more than two watches, and that the cylinders can be controlled by the same or different controllers.

FIG. 8 illustrates circuit board 88 mountable on the upper surface of watch winder enclosure 58. In addition to sensor 50, board 88 includes LED display 90, which can be used to display the correct time as a convenience to the user in setting the time of watches being wound, and can also be used to display the time a watch is wound, or the number of rotations of cylinder 16, depending on how display 90 is programmed. Dip switch 92 can be set to different positions to control the number of times that the winder is activated, or the degrees that the cylinder is turned, during a day or other given time period.

In operation of the embodiment shown in FIG. 1-3, the user places watch 22 on watch holder 16, with watchband 24 around holder 16 and watch 22 on the outer face of holder 16. Holder 16 is then inserted into the end of cylinder 14, which is placed on the upper surfaces of rollers 38, 40, 44 and 46. Motor 52 is then energized either by controller 58 or manually with switch 56 causing cylinder 14 to rotate.

Sensor 50 detects features 48 as cylinder 14 is rotated. Controller 58 receives data input regarding sensed features 48 from sensor 50. When a predetermined number of features 48 equal to more or less than the total number of features 48 are detected, controller 58 opens the circuit to end the winding cycle. After a programmed time period, controller 58 closes the circuit to initiate another winding cycle. After the predetermined number of features 48 have been counted, the circuit is again opened.

Since the number of features that are counted to open the circuit are different from the number of features present on the cylinder, the position of the cylinder at the end of each cycle will differ by a number of degrees from the position of the cylinder at the end of the immediately preceding winding cycle. To illustrate, if the cylinder has 12 equidistant features, and if the controller was programmed to open after counting of exactly 12 features, the cylinder would always stop at the same position. However, if the controller is programmed to open the circuit after counting 11 or 13 features, the cylinder will be oriented at 30° from its position at the end of the immediately preceding winding cycle. That is, the cylinder in this instance will rotate 330° if the controller is set for 11 counts or 390° if the controller is set for 13 counts.

Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. A watch winder comprising:

a) a watch carrier having a longitudinal axis;

b) drive means for rotating said watch carrier about said longitudinal axis; and c) a controller to control the rotation of said watch carrier through successive winding cycles, said controller stopping said watch carrier at the end of each cycle with the orientation of the watch carrier being a predetermined number of degrees different from the orientation of the watch carrier at the end of the immediately preceding cycle.

2. The winder of claim 1, wherein said carrier includes an outer watch carrying face perpendicular to said longitudinal axis.

3. The winder of claim 1, wherein said carrier includes a housing with a longitudinal axis and a watch holder insertable into the interior of housing.

4. The winder of claim 1, further including a rest adapted to freely support said carrier, said rest including at least one drive surface positioned to engage and rotate said carrier when said carrier is supported on said rest.

5. The winder of claim 1, wherein said drive means includes a motor in operative communication with said drive surface, and control circuitry controlling when said motor is energized.

6. The winder of claim 1, wherein said carrier longitudinal axis is horizontal.

7. The winder of claim 1, wherein said controller stops the rotation of said carrier in response to a sensed feature on said carrier.

8. A watch winder for winding a watch during successive winding cycles comprising:

a) a watch carrier having a longitudinal axis and a plurality of detectable features;

b) drive means for rotating said watch carrier about said longitudinal axis; and c) a sensor to detect said detectable features; and d) a controller to stop the rotation of said carrier at the end of each winding cycle in response to detection of a detectable feature by said sensor with the orientation of said watch carrier being a predetermined number of degrees different from the orientation of said watch carrier at the end of the immediately preceding winding cycle.

9. The winder of claim 8, wherein said carrier includes an outer watch carrying face perpendicular to said longitudinal axis.

10. The winder of claim 8, wherein said carrier includes a continuous outer wall and said detectable features are positioned on said wall.

11. The winder of claim 8, wherein said features move along a given pathway upon rotation of said carrier, said sensor being positioned adjacent said pathway.

12. The winder of claim 8, wherein said features are reflective features and said sensor is an optical sensor.

13. The winder of claim 8, wherein the number of said features is equally divisible into 360.

14. The winder of claim 8, wherein said controller stops the rotation of said carrier upon detection by said sensor of a number of features different from the number of features on said carrier.

15. The winder of claim 8, wherein carrier rotates at least 360° plus a predetermined number of degrees during each winding cycle.

16. A watch winder to wind a watch during successive winding cycles comprising:

a) a cylinder having a given diameter, a given length, a longitudinal axis, a continuous outer wall, a plurality of detectable features, an interior, and opposed ends;

b) a watch holder insertable into the interior of said cylinder;

c) a cylinder rest adapted to freely support said cylinder, said rest including at least one drive surface positioned to engage and rotate said cylinder when said cylinder is supported on said rest; and d) an electrical circuit including an electric motor operatively connected to said drive surface, a sensor to detect said detectable features, and a controller to open said circuit at the end of each winding cycle in response to detection of said detectable features by said sensor with the orientation of said watch holder being a predetermined number of degrees different from the orientation of said watch holder at the end of the immediately preceding winding cycle.

17. The winder of claim 16, wherein said carrier includes an outer watch carrying face perpendicular to said longitudinal axis.

18. The winder of claim 16, wherein said rest is adapted to support said cylinder in a horizontal position.

19. The watch winder of claim 16, wherein said detectable features are reflective surfaces on the outer wall of said cylinder.

20. The winder of claim 16, wherein said features move along a given pathway in a plane perpendicular to said longitudinal axis upon rotation of said carrier, said sensor being positioned adjacent said pathway.

21. The winder of claim 16, wherein the number of said features is equally divisible into 360.

22. The winder of claim 16, wherein said controller stops the rotation of said carrier upon detection by said sensor of a number of features different from the number of features on said carrier.

23. The winder of claim 16, wherein carrier rotates at least 360° plus a predetermined number of degrees during each winding cycle.

24. A method of winding a self-winding watch during a plurality of winding cycles comprising:

a) positioning said watch relative to an axis of rotation; and b) rotating said watch about said axis of rotation through successive winding cycles, stopping the rotation of said watch at the end of each cycle with the orientation of the watch being at a predetermined number of degrees different from the orientation of the watch at the end of the immediately preceding cycle.

25. The method of claim 24, wherein the orientation of the watch at the end of each cycle is from about 10° to about 30° relative to the orientation of the watch at the end of the immediately preceding cycle.

26. The method of claim 24, further including the steps of sensing one of a plurality of detectable features, and ending each cycle in response to the sensing of a detectable feature different from the detectable feature sensed at the end of the immediately preceding cycle.

27. The method of claim 24, including the step of positioning the watch in a holder having an outer wall, said detectable features being on said outer wall.

28. The method of claim 24, wherein the orientation of said watch carrier at the end of each winding cycle differs from the orientation of said watch carrier at the end of the immediately preceding winding cycle by a number of degrees equally divisible into 360.

29. The method of claim 24, wherein said carrier is rotated at least 360°, plus a predetermined number of degrees during each winding cycle.

* * * * *